US006195435B1

(12) United States Patent
Kitamura

(10) Patent No.: US 6,195,435 B1
(45) Date of Patent: Feb. 27, 2001

(54) METHOD AND SYSTEM FOR CHANNEL BALANCING AND ROOM TUNING FOR A MULTICHANNEL AUDIO SURROUND SOUND SPEAKER SYSTEM

(75) Inventor: John S. Kitamura, Toronto (CA)

(73) Assignee: ATI Technologies, Thornhill (CA)

( * ) Notice: Subject to any disclaimer, the term of this patent is extended or adjusted under 35 U.S.C. 154(b) by 0 days.

(21) Appl. No.: 09/071,027

(22) Filed: May 1, 1998

(51) Int. Cl.[7] ..... H04R 5/00

(52) U.S. Cl. ..... 381/18; 381/19; 381/98; 381/104

(58) Field of Search ..... 381/1, 18, 19, 381/20, 17, 21, 22, 23, 98, 101, 103, 104, 107

(56) References Cited

U.S. PATENT DOCUMENTS

| | | |
|---|---|---|
| 4,064,364 | 12/1977 | Veale . |
| 4,152,649 | 5/1979 | Choquet . |
| 4,352,190 | 9/1982 | Hullwegen . |
| 4,769,848 | 9/1988 | Eberbach . |
| 4,910,779 | 3/1990 | Cooper et al. . |
| 5,283,819 | 2/1994 | Glick et al. . |
| 5,412,691 | 5/1995 | Ginzburg et al. . |
| 5,438,623 | 8/1995 | Begault . |
| 5,583,560 | 12/1996 | Floriin et al. . |
| 5,594,509 | 1/1997 | Florin et al. . |
| 5,602,928 | 2/1997 | Eriksson et al. . |

*Primary Examiner*—Minsun Oh Harvey
(74) *Attorney, Agent, or Firm*—Markison & Reckamp, P.C.

(57) ABSTRACT

A system and method for providing channel balancing and room tuning for a multi-channel audio surround sound speaker system passes source audio to automatically configured multi-channel compensation filters to provide equalization on a per channel basis for speakers having differing response characteristics. The speakers correspond to each of the surround sound channels. To automatically configure the multi-channel compensation filters, a controller generates common room tuning deviation data based on the frequency response characteristic data of each of the speakers. In addition, the system and method also generates room corrected channel deviation data for each channel by correcting a selected speaker response based on room tuning compensation requirement data derived from the common room tuning deviation data. Automatic channel balancing is provided by determining channel balancing compensation requirement data based on the corrected channel deviation data for each channel.

20 Claims, 5 Drawing Sheets

L & R CHANNEL DEVIATION VS. FLAT RESPONSE (L & R) VS. (Ls & Rs) DEVIATION

METHOD AND SYSTEM FOR CHANNEL BALANCING AND ROOM TUNING FOR A MULTICHANNEL AUDIO SURROUND SOUND SPEAKER SYSTEM

BACKGROUND OF THE INVENTION

The invention relates generally to audio control systems and more particularly to computer based audio control systems for multichannel audio surround sound systems.

With the proposal of increased video and audio applications in multimedia personal computers, a user can potentially use the computer to control the television, telephone and home stereo as well as connect signals from cable television links, satellite TV and various other video/audio sources such as compact disc (CD) players, VCRs and digital versatile disc (DVD) players to the home entertainment system.

Some high-end home entertainment systems have multichannel audio systems, such as surround sound systems with three or more channels to provide theater sound effects. The surround sound channels are often presented at a lower volume level than front channels since movies contain most of the audio information in the front channels and use the surround channels sparingly as effects channels. A typical surround multichannel system may include six channels. These channels typically consist of a left, right and center front channel, a left and right surround channel and a subwoofer channel. Differing prerecorded equalization settings among surround channel recording or among the various formats can sound different on the same speakers.

The first surround systems sold to consumers were generally meant for playback of surround sound movies. These movie sound tracks typically had an uneven distribution of information to the six speakers in the system. Because of this, many surround sound systems exist with unmatched speakers. In other words each speaker has its own physical limitations corresponding to the information expected in that channel. However, for multi-channel music, an even distribution of audio information is expected in each channel. For example, in a movie soundtrack, the low frequency or subwoofer channel typically carries all the low frequency information. Typically this means that all other channels will have a minimum of low frequency information and as such the remaining five speakers are not required to provide quality low frequency output. The center channel typically carries mostly dialog, with some residual effects information and some music information. The speaker corresponding to the center channel is usually limited to playback in the vocal frequency range and can provide more energy than left and right and speakers and surround left and right surround channel speakers. The left and right channels typically carry most of the music soundtrack, and as such, the corresponding speakers have a wide frequency range. The left and right surround channels usually carry only sound effects and are therefore generally limited in frequency range and in power. Accordingly, speakers used for left and right surround channels typically have limited frequency ranges and power ranges.

A problem can arise for multi-channel music since the left, center, right, left surround and right surround speakers can all carry music and are expected to be matched and capable of handling the full range of frequencies. In fact, some multi-channel music mixes do not use the subwoofer as it has been known to artificially boost the low frequencies. Therefore each of the remaining five speakers are expected to handle the low frequency energy as well as the mid range and higher frequencies. Purchasing a new set of matching speakers to take further advantage of the newer multichannel music recordings is unnecessarily costly. Moreover, it would be advantageous to have a flexible audio system that could automatically compensate for speaker limitations with minimal user intervention.

Some automatic equalization systems are known that may automatically generate filter coefficients and delay parameters to compensate for physical limitations of an audio playback system. Such systems are typically for use in concert halls and professional recording studios. With such systems, the operator typically needs to know details about complex variables including room attenuation parameters, speaker response characteristics and other information which is not generally known to average consumers. Moreover such systems are typically very costly and do not lend themselves to mass market use. Accordingly, it would be desirable to have a automatic channel balancing and room tuning system that may be used on a multimedia computer system or other consumer data processing systems for enhancing multi-channel audio surround sound systems.

In addition to the unmatched speakers, the nature of the room in which the speakers are placed will also affect the sound. As is known, sound reflects off certain surfaces and may be absorbed by other surfaces. Some surfaces diffuse audio signals, causing some frequencies to be canceled out. Other frequencies may resonate if the wave length of the frequency and the dimensions of the room are matched. It would be desirable if a lower cost surround sound channel system were able to compensate to reduce the more offensive resonances and cancellations.

Therefore a need exists for an automatic channel balancing method and system to help maximize performance of surround sound systems. Such a system should automatically compensate for the physical limitations of the room and differing response characteristics of the speakers in the surround sound system.

DETAILED DESCRIPTION OF THE INVENTION

A system and method for providing channel balancing and room tuning for a multi-channel audio surround sound speaker system passes source audio to a set of automatically configured multi-channel compensation filters to provide equalization on a per channel basis for speakers having differing response characteristics. The speakers correspond to each of the surround sound channels. To automatically configure the multi-channel compensation filters, the disclosed method and system generates common room tuning deviation data based on common characteristics of the frequency response characteristic data from all of the speakers. In addition, the system and method also generates room corrected channel deviation data for each channel by correcting a selected speaker response based on room tuning compensation requirement data derived from the common room tuning deviation data. Automatic channel balancing is provided by determining channel balancing compensation requirement data based on the corrected channel deviation data for each channel. Where a low frequency speaker is used, the channel balancing compensation requirement data is calculated so that low frequency modifications are accommodated by the low frequency speaker.

In one embodiment, the common room tuning deviation data and room corrected channel deviation data is obtained by sequentially transmitting a multi-channel speaker test signal for each of the plurality of speakers in the room. The speaker test signal is used to determine the frequency response characteristic of each speaker. Like speakers are compared (e.g., L and R, LS and RS) to obtain channel dependent room characteristics. Response curve data is correlated to obtain common room characteristics and compensation requirement data, such as compensation filter coefficients. The characteristic response data (response curve) is corrected accordingly. The response data corrected for room characteristics is then compared to ideal response data to determine the necessary channel balancing requirement. The appropriate multi-channel equalizer filter coefficients and delay parameters are then calculated to adjust the source audio in a manner such that the resulting output from each of the speakers is approximately the same over the frequency range in a given channel.

Figure 1:
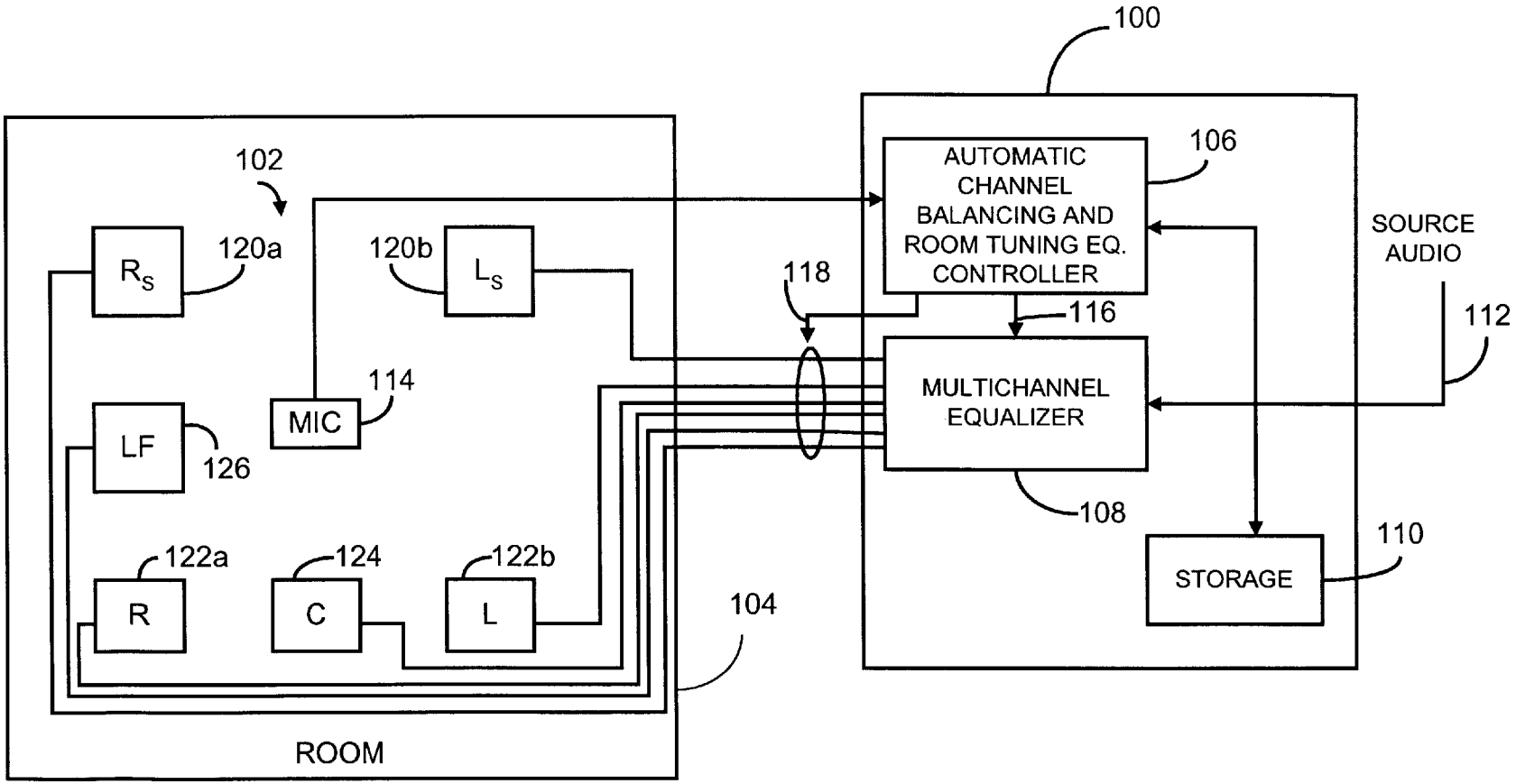
FIG. 1 is a block diagram generally depicting one embodiment of a self channel balancing and room tuning system for multi-channel audio surround sound speaker system.

FIG. 1 shows one example of a channel balancing and room tuning system 100 for a multi-channel audio surround sound speaker system 102 located in a room 104. The channel balancing and room tuning system 100 may be incorporated in a multimedia computer or in a stand alone computing system or in any other suitable device. The channel balancing and room tuning system 100 includes an automatic channel balancing and room tuning equalization controller 106, a multi-channel equalizer 108 having an FIR filter for each of the multichannels, and a storage device 110. The multichannel equalizer 108 receives source audio 112 which may come from any suitable audio source such as a DVD player, Internet connection or any other suitable audio source. The audio source that generates the source audio 112 is a surround sound audio source generator generating multichannels (such as six) of audio. It will be recognized however that any other suitable number of channels may also be accommodated. A microphone 114 is connected to the automatic channel balancing and room tuning equalization controller 106 and receives audio output by any or all of the surround sound speakers 102. The automatic channel balancing and room tuning equalization controller 106 generates equalization parameters 116, such as FIR filter coefficients and filter delay coefficients, to automatically configure each of the multi-channel compensation filters in the multichannel equalizer 108. The automatic channel balancing and room tuning equalization controller 106 also sequentially transmits a multi-channel speaker test signal 118 for each of the pluralities of speakers 102 in the room 104.

The surround sound speakers 102 include a right surround (RS) channel speaker 120*a*, a left surround (LS) channel speaker 120*b*, a right channel (R) speaker 122*a*, a left channel (L) speaker 122*b*, a center channel (C) speaker 124, and a low frequency channel (LF) speaker 126 (subwoofer). Typically, the right surround speaker 120*a* and left surround speaker 120*b* are matched (of the same type), meaning that the frequency responses of the speakers are substantially the same, but are not necessarily the same type as the right and left channel speakers 122*a* and 122*b*. Likewise, right channel speaker and left channel speakers 122*a* and 122*b* are also typically matched and the center channel speaker is of a different speaker type. However, to get suitable audio output for surround sound music, it is important to match all five speakers (excluding the subwoofer), and as such the audio input to each speaker must be compensated given the limited response characteristics of the various speaker pairs and individual speakers since they should preferably output audio over a broader range than conventionally intended.

Figure 2:
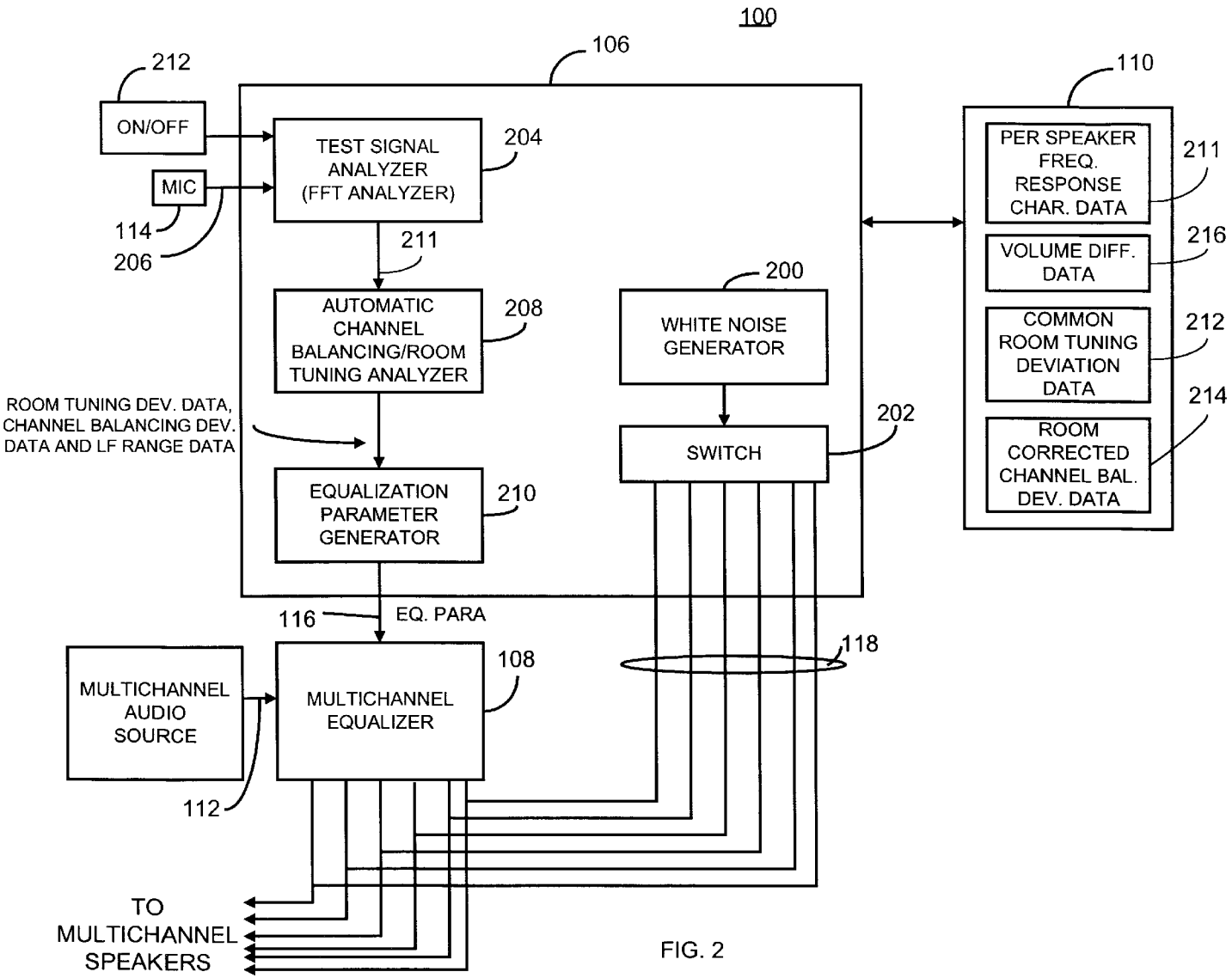
FIG. 2 is a block diagram illustrating one embodiment of an automatic channel balancing and room tuning system in accordance with one embodiment of the invention.

FIG. 2 shows the channel balancing and room tuning system 100 having a white noise generator 200 that generates the test signal 118 for each of the surround sound speakers 102. It will be recognized that any suitable frequency sweeping mechanism may also be used. The white noise generator 200 is connected to a switch 202 that switches the test signal generated by the white noise generator 200 to the appropriate surround sound speaker in a selective and sequential manner. The automatic channel balancing and room tuning equalization controller 106 also includes a test signal analyzer 204 such as a fast Fourier transform analyzer (FFT). The test signal analyzer 204 automatically analyzes received multi-channel test signal 206 as received by the microphone 114 after the test signal is output by a given speaker. The test analyzer 204 generates frequency response characteristic data for each speaker based on received test signal. The test signal analyzer 204 after generating the frequency response characteristic data for each speaker, stores the frequency response characteristic data for each speaker in data store 110.

The automatic channel balancing and room tuning equalization controller 106 also includes an automatic channel balancing and room tuning analyzer 208 and an equalizer parameter generator 210. The automatic channel balancing and room tuning analyzer 208 receives frequency response characteristic data 211 on a per speaker basis and generates upon analyzing the information, common room tuning deviation data 212, room corrected channel deviation data 214, and low frequency range data as will be described below. Based on this information, the equalizer parameter generator 210 generates equalization filter parameters 1 16, such as finite impulse response filter coefficients and delay coefficients for the multi-channel equalizer 108.

An on/off switch 212 may also optionally be provided so that the automatic channel balancing and room tuning equalization system 100 may be turned off after the requisite filter coefficients and delay coefficients have been generated for each surround sound channel filter. The on/off switch 212 may be any suitable switching mechanism, for example a graphic user interface button or hardwired switch.

The automatic channel balancing and room tuning equalization controller 106 may be implemented as software in any suitable computer. Similarly, the multi-channel equalizer 108 may be implemented in software as well. One example of a suitable multi6 channel equalizer 108 is disclosed in co-pending U.S. patent application Ser. No. 08/944,055, hereby incorporated by reference, having as inventor, John Kitamura, and assigned to instant assignee.

The test signal analyzer 204 automatically analyzes the received multi-channel test signal for each of the plurality of speakers 102 and generates frequency response characteristic data for a given speaker based on the received multi-channel test signal. The automatic balancing and room tuning analyzer 208 generates room corrected channel deviation data 214 based on correlating channel deviation data from all of the speakers to determine commonalities among all of the frequency response characteristic data. In addition to determining common room tuning effects, the automatic balancing and room tuning analyzer 208 also generates volume level difference data to facilitate channel specific room tuning. The multi-channel equalizer 108 equalizes the source audio 112 based on the common room tuning deviation data and room corrected channel deviation data which is used to determine the filter coefficients and delay coefficients used by the multi-channel equalizer 108. The multi-channel equalizer 108 includes a plurality of FIR filters, preferably one for each surround channel which are automatically configured under software control by loading the filter coefficient and delay coefficient information (the equalization parameter is 116). This is done on a per channel basis so that each speaker which has a different response characteristic may be independently controlled by adjusting the source audio accordingly.

Figure 3A:
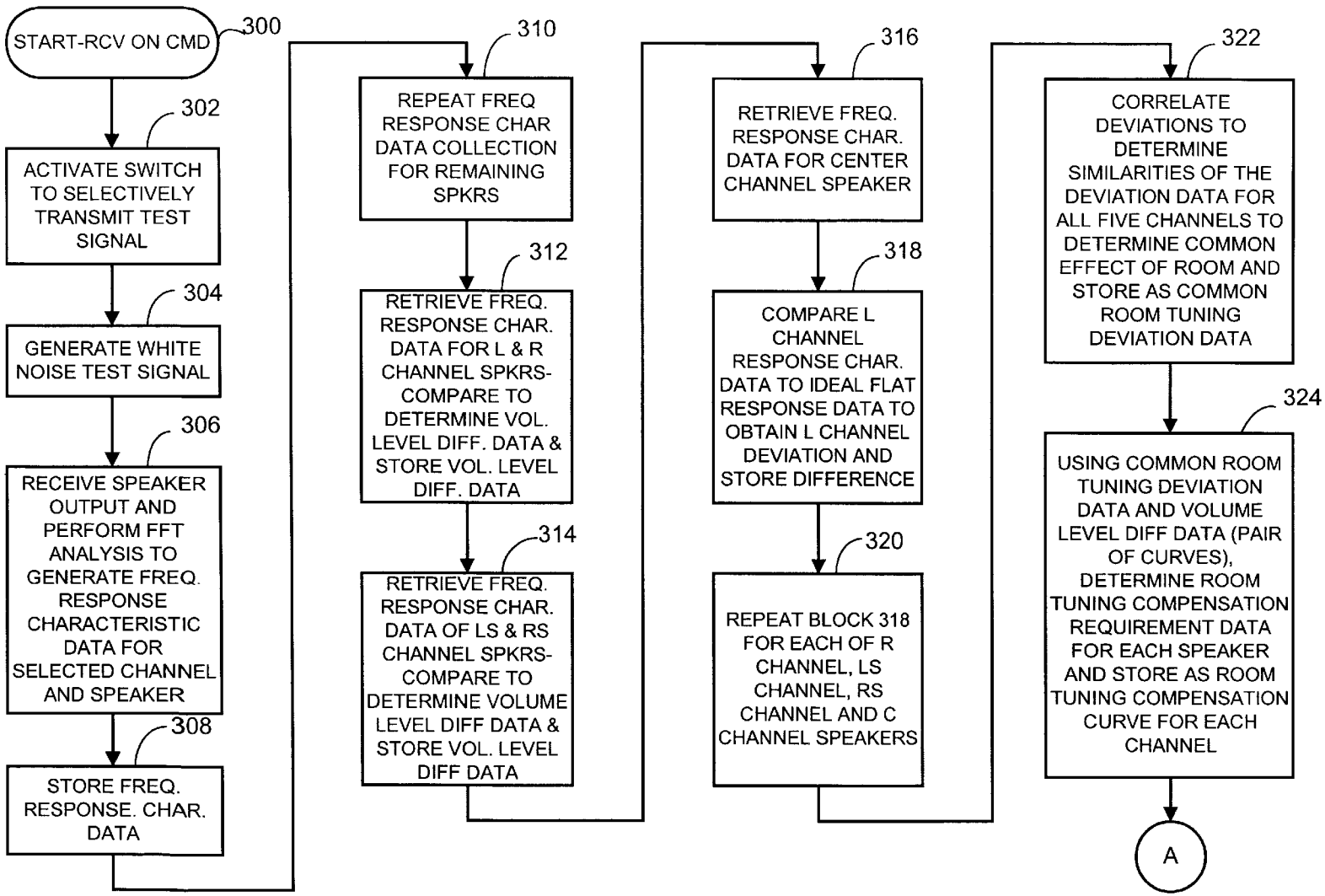
FIGS. 3 illustrates a flowchart depicting a method of channel balancing and room tuning for a multi-channel audio surround sound speaker system in accordance with one embodiment of the invention.
Figure 3B:
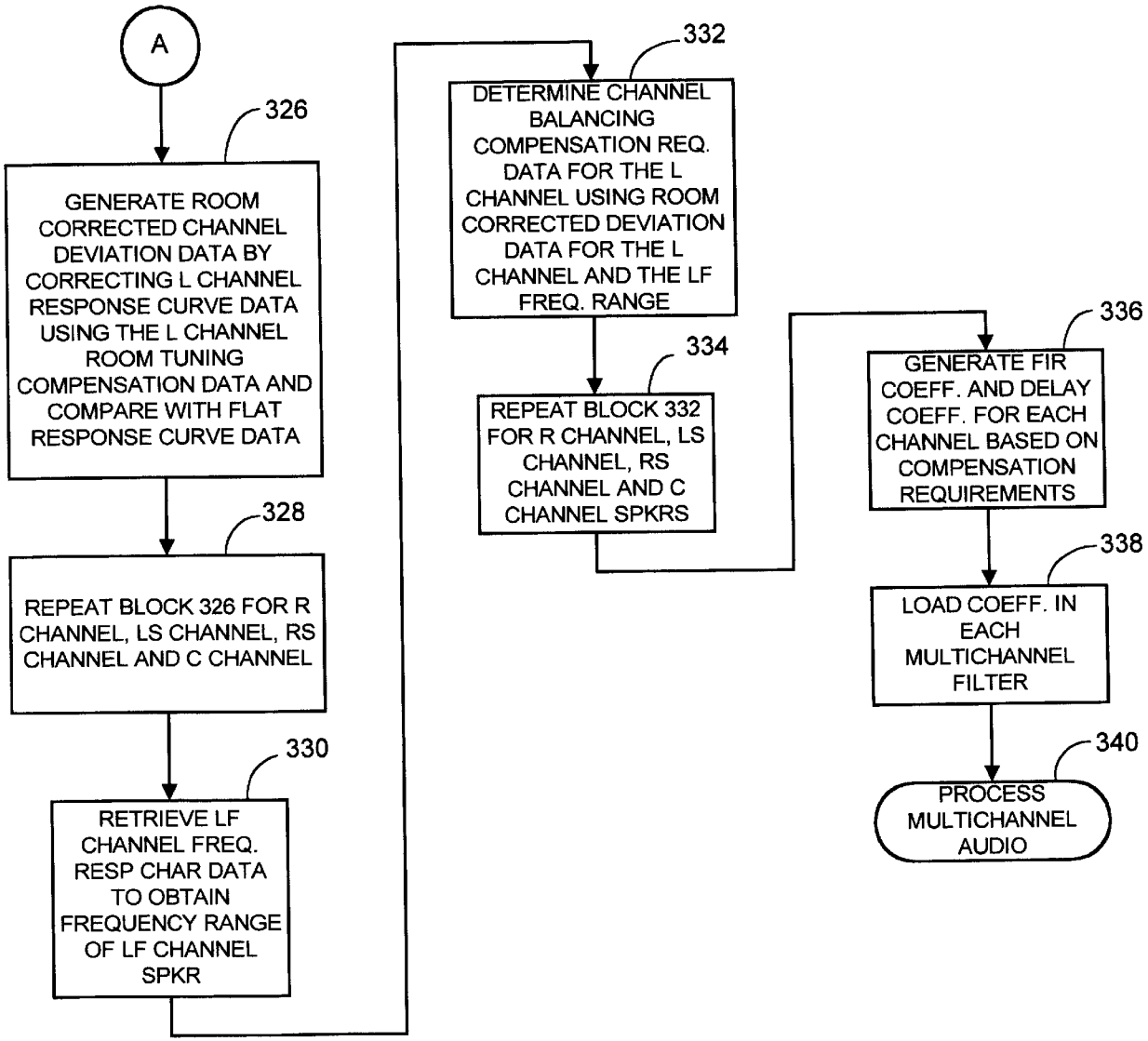

Referring to FIGS. 2 and FIGS. 3*a*–3*b*, in operation, a user places the microphone 114 in the room 104 as shown in block 300. The user also activates the on/off switch 212 to turn on the automatic channel balancing and room tuning equalization system 100. The controller 106 then activates the tri-state switch 202 to select one of the surround sound speakers 102 as shown in block 302. The white noise or test signal generator 200 generates preferably, an even distribution of information across a desired frequency spectrum. This is shown in block 304. The switch 202 selectively switches a multi-channel speaker test signal 118 to each speaker although one speaker is connected at a time. With one speaker connected and generating white noise from the multi-channel speaker test signal, the microphone receives the speaker output. The test signal analyzer 204 receives the received test signal and performs a fast Fourier transform analysis to generate a digital frequency response, namely the frequency response characteristic data for the given speaker in the room as shown in block 306. In this way, the automatic channel balancing and room tuning equalization controller 106 generates the frequency response characteristic data for each speaker.

As shown in block 308, the controller stores the generated frequency response characteristic data for the given speaker in data store 110. The system 100 then repeats the frequency response characteristic data collection for each of the remaining speakers in sequence as shown in block 310. This is performed by the controller 106 sequentially transmitting a multi-channel test signal to each of the multi-channel speakers 102 individually. As shown in block 312, the automatic balancing and room tuning analyzer 208 retrieves the stored frequency response characteristic data from data store 110 for left channel and right channel speakers 122*a* and 122*b*. The difference in the response by each of the speakers is compared to determine a difference in volume levels between the right channel and left channel speakers 122*a* and 122*b*. This difference in volume levels is stored as volume difference level data in data 216 store 110. Similarly, the automatic balancing and room tuning analyzer 208 retrieves the frequency response data corresponding to the left and right surround sound speakers 120*a* and 120*b* to determine a difference in volume levels between these two speakers, as shown in block 314. This volume level difference data is also stored in data store 110. Also, the automatic analyzer 208 retrieves the frequency response characteristic data for the center channel speaker 124, as shown in block 316.

As shown in block 318, the automatic analyzer 208 compares the left channel frequency response characteristic data to the reference flat response data to obtain the left channel deviation data. The reference flat response data is data representing an ideal speaker response in an ideal room, where each frequency band is perceived by a listener to have an equal volume. This left channel deviation information is stored. In addition the automatic analyzer 208, repeats the same process for the R, LS, RS and C channel speakers, as shown in block 320. The automatic analyzer 208 correlates the initial stored deviations of the five channels (L, R, LS, RS, C) to obtain commonalities in the deviation data. The common frequencies (and dB levels) are stored as the common room tuning deviation data 212 as shown in block 322. As shown in block 324, the automatic analyzer 208 retrieves the pair of volume difference level data (curves) and the common room tuning deviation data and calculates the room tuning requirement data, data representing the filter coefficients necessary to remove the effects of the room, for each of the five speaker channels. Any deviations common to all channels is assumed to be an artifact of the room characteristics. A compensation filter is calculated for each of the five speaker channels and a resultant room tuning compensation curve (room tuning compensation requirement data) is stored for each of the five speakers.

Automatic analyzer 208 applies the L channel room tuning compensation curve to the L channel frequency response curve, and generates room corrected deviation data in the form of a curve. This is shown in block 326 (FIG. 3*b*). As shown in block 328, the processing step 326 is repeated for the R, LS, RS and C channels. As shown in block 330, the automatic analyzer 208 retrieves the LF frequency response curve to determine the frequency range of the LF channel.

The automatic analyzer 208 uses the L channel room corrected channel deviation data and the LF frequency range to determine the L channel balancing compensation requirement data. This is shown in block 332. The LF frequency range data is used to determine the low frequency cutoff range for the L channel speaker. Any overlapping low frequency is preferably removed from the L channel and left for the LF channel. As shown in block 334, the automatic analyzer 208 repeats the same process with R, LS, RS and C channels. In block 336 the automatic analyzer 208 retrieves the L channel room tuning compensation requirement data and the L channel balancing compensation requirement data to generate a suitable L channel compensation requirement and the equalization parameter generator 210 generates the requisite filter coefficients and delay coefficients for a corresponding L speaker multichannel filter. The controller 106 then loads the generated filter coefficients and delay coefficients into each filter which is associated with each channel in the multi-channel equalizer 108 as shown in block 338. Thereafter, the multi-channel equalizer 108 is allowed to pass the multi-channel audio source 112 through the filters to process the multi-channel audio as shown in block 340.

The volume difference data 216 represents differences in volume levels between each speaker in a pair of at least left and right channel speakers corresponding with the left and right channels. The volume difference data 216 is based on the stored frequency response characteristic data associated with the corresponding left and right speakers. Also it is seen from FIGS. 3*a*–3*b* that the common room tuning deviation data is used to determine common audio compensation requirement common for all of the speakers whereas the channel balancing compensation requirement data is determined for the left and right channel pair, the left and right surround channel pair, the center channel, and the low frequency channel based on the room corrected channel deviation data. The filter coefficients and delay coefficients are generated on a per channel basis.

Figure 4A:
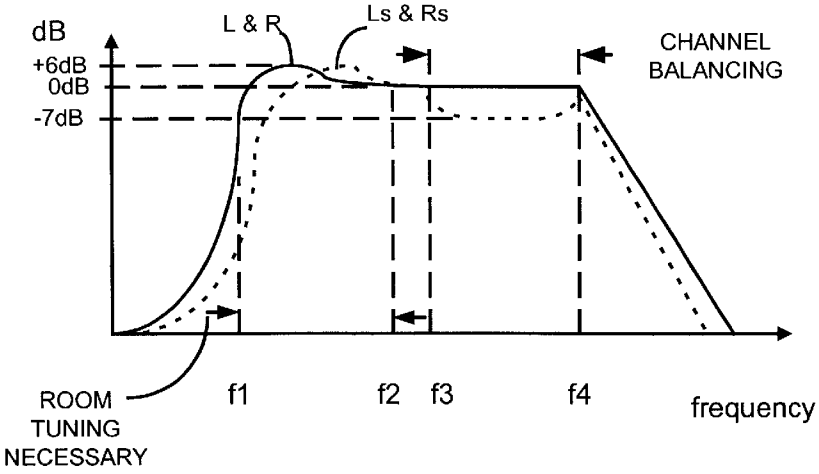
FIG. 4 is graphic illustrations showing balancing and common room tuning deviation data and compensation requirement data in accordance with one embodiment of the invention.
Figure 4B:
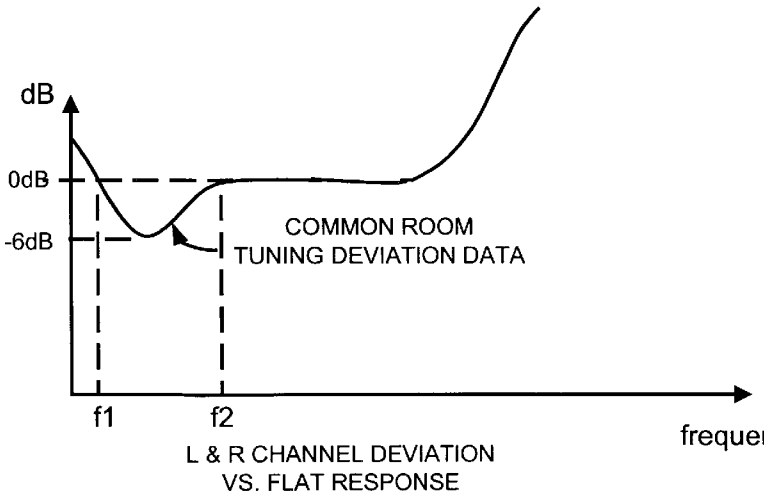
Figure 4C:
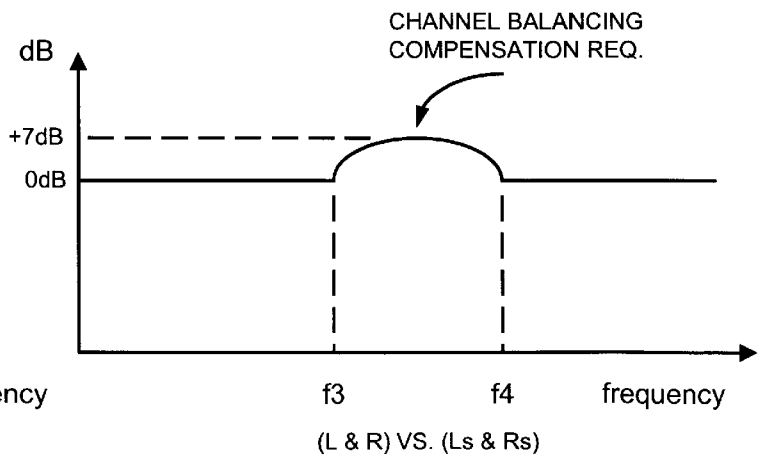

An example of determining room tuning compensation data and channel balancing compensation data is shown with reference to FIGS. 4*a*–4*c*. As shown in FIG. 4*a*, a digital frequency response characteristic curve of the left and right channel is indicated by a solid line whereas frequency response characteristic data of the left and right surround speakers is shown by a dashed line. To obtain a flat response for each speaker, the source audio must be appropriately equalized. As seen, both pairs of left and right channel speaker response characteristic data and left and right surround channel speaker response characteristic data share a common 6 dB gain in the frequency band between F1 and F2. Room tuning is necessary for these frequencies. This is done for both the left and right channel speakers and the left and right surround channel speakers. Only the left and right surround channel speakers show a 7 dB attenuation in the frequency band between F3 and F4. Therefore, channel balancing is required only for the left and right surround channels since the output of the speakers at these frequency levels does not meet the flat response characteristic. This is shown at frequencies F2 through F3.

As shown in FIG. 4*b*, in determining the room tuning compensation requirement data of the left and right channel with respect to the flat response, it can be seen that room tuning is required since the compensation requirement data indicates the frequencies F1 through F2 for the set of left and right channels and the set of left and right surround channels do not match the reference response data. Hence the source audio should be modified in these speaker sets to match the flat response curve.

In FIG. 4*c*, the deviation between the left and right channel frequency response data and the left and right surround channel response data and the left and right surround channel response data is shown. As indicated there is a channel balancing compensation requirement at frequencies between F3 and F4 for the left and right surround channel speakers. The deviation is based on comparing left and right channel speaker response characteristic data as the reference. The left and right surround channel speaker response characteristic data shows that the source audio must be modified on the channel's left surround and right surround between the frequency range F3–F4.

It should be understood that the implementation of other variations and modifications of the invention in its various aspects will be apparent to those of ordinary skill in the art, and that the invention is not limited by the specific embodiments described. It is therefore contemplated to cover by the present invention, any and all modifications, variations, or equivalents that fall within the spirit and scope of the basic underlying principles disclosed and claimed herein.

What is clamed is:

1. A method of channel balancing and room tuning for a multichannel audio surround sound speaker system having a speaker associated with each of the multichannels and wherein the multichannels include at least a left channel, a right channel, a center channel, a left surround channel and a right surround channel, comprising the steps of:

sequentially transmitting a multichannel speaker test signal for each of the plurality of speakers in a room;

automatically analyzing a received multichannel test signal from each of the plurality of speakers and generating frequency response characteristic data for a given speaker based on the received multichannel test signal;

generating common room tuning deviation data based on correlating channel deviation data from all speakers;

generating room corrected channel deviation data for each channel by correcting a selected speaker response based on room tuning compensation requirement data derived from the common room tuning deviation data;

determining channel balancing compensation requirement data based on the corrected channel deviation data for each channel; and equalizing source audio based on the common room tuning deviation data and the room corrected channel deviation data.

2. The method of claim 1 wherein the step of equalizing source audio includes passing source audio through automatically configured multichannel compensation filters to provide equalization on a per channel basis for speakers having differing response characteristics on a per channel pair basis.

3. The method of claim 1 wherein the step of sequentially transmitting the multichannel speaker test signal includes selectively switching the multichannel speaker test signal to each speaker and wherein the step of generating frequency response characteristic data for each speaker includes analyzing the received multichannel test signal for each speaker using a Fast Fourier Transform (FFT).

4. The method of claim 3 including the step of storing the frequency response characteristic data of each speaker and wherein the step of generating common room tuning deviation data includes determining volume difference data representing differences in volume levels between pairs of at least left and right speakers associated with the left and right channels based on the stored frequency response characteristic data.

5. The method of claim 1 wherein the step of generating common room tuning deviation data includes generating volume level difference data to facilitate channel specific room tuning.

6. The method of claim 5 wherein the step of equalizing source audio includes generating finite impulse response (FIR) filter coefficients and delay coefficients on a per channel basis based on the common audio compensation requirement data and the channel balancing compensation requirement data.

7. A method of channel balancing and room tuning for a multichannel audio surround sound speaker system having a speaker associated with each of the multichannels and wherein the multichannels include at least a left channel, a right channel, a center channel, a left surround channel and a right surround channel, comprising the steps of:

generating common room tuning deviation data based on correlating channel deviation data from all speakers;

generating room corrected channel deviation data for each channel by correcting a selected speaker response based on room tuning compensation requirement data derived from the common room tuning deviation data;

determining channel balancing compensation requirement data based on the corrected channel deviation data for each channel; and equalizing source audio based on the common room tuning deviation data and the room corrected channel deviation data.

8. The method of claim 7 wherein the step of generating common room tuning deviation data includes comparing frequency response characteristic data associated with each channel to ideal response data and generating room tuning compensation requirement data, and wherein the step of generating room corrected channel deviation data includes comparing room tuned corrected channel response characteristic data to ideal response characteristic data.

9. The method of claim 7 including determining channel balancing compensation requirement data for the left and right channel, the left and right surround channel, and the center channel based on a frequency range of a low frequency channel.

10. The method of claim 7 wherein the step of equalizing source audio includes passing source audio through automatically configured multichannel compensation filters to provide equalization on a per channel basis for speakers having differing response characteristics on a per channel pair basis.

11. A channel balancing and room tuning system for a multichannel audio surround sound speaker system having a speaker associated with each of the multichannels and wherein the multichannels include at least a left channel, a right channel, a center channel, a left surround channel and a right surround channel, comprising:

means for sequentially transmitting a multichannel speaker test signal for each of the plurality of speakers in a room;

means for receiving the transmitted multichannel speaker test signal for each of the plurality of speakers in the room;

means, operatively coupled to the means for receiving, for automatically analyzing the received multichannel test signal from each of the plurality of speakers and for generating frequency response characteristic data for a given speaker based on the received multichannel test signal;

means, responsive to the frequency response characteristic data, for generating common room tuning deviation data based on correlating channel deviation data from all speakers, means, responsive to the frequency response characteristic data, for generating room corrected channel deviation data for each channel by correcting a selected speaker response based on room tuning compensation requirement data derived from the common room tuning deviation data;

means, responsive to the room corrected channel deviation data, for determining channel balancing compensation requirement data based on the room corrected channel deviation data for each channel; and means, responsive to the means for generating common room tuning deviation data and to the means for generating room corrected channel deviation data, for equalizing source audio based on the common room tuning deviation data and the room corrected channel deviation data.

12. The system of claim 11 wherein the means for equalizing source audio passes source audio through automatically configured multichannel compensation filters to provide equalization on a per channel basis for speakers having differing response characteristics on a per channel pair basis.

13. The system of claim 11 wherein the means for sequentially transmitting the multichannel speaker test signal includes means for selectively switching the multichannel speaker test signal to each speaker and wherein the means for generating frequency response characteristic data for each speaker analyzes the received multichannel test signal for each speaker using a Fast Fourier Transform (FFT).

14. The system of claim 13 including means for storing the frequency response characteristic data of each speaker and wherein the means for generating common room tuning deviation data determines volume difference data representing differences in volume levels between pairs of at least left and right speakers associated with the left and right channels based on the stored frequency response characteristic data.

15. The system of claim 11 wherein the means for generating common room tuning deviation data generates volume level difference data to facilitate channel specific room tuning.

16. The system of claim 15 wherein the means for equalizing source audio generates finite impulse response (FIR) filter coefficients and delay coefficients on a per channel basis based on the common audio compensation requirement data and the channel balancing compensation requirement data.

17. A channel balancing and room tuning system for a multichannel audio surround sound speaker system having a speaker associated with each of the multichannels and wherein the multichannels include at least a left channel, a right channel, a center channel, a left surround channel and a right surround channel comprising:

means, responsive to frequency response characteristic data, for generating common room tuning deviation data based on correlating channel deviation data from all speakers, means, responsive to the frequency response characteristic data, for generating room corrected channel deviation data for each channel by correcting a selected speaker response based on room tuning compensation requirement data derived from the common room tuning deviation data;

means, responsive to the room corrected channel deviation data, for determining channel balancing compensation requirement data based on the room corrected channel deviation data for each channel; and means, responsive to the means for generating common room tuning deviation data and to the means for generating room corrected channel deviation data, for equalizing source audio based on the common room tuning deviation data and the room corrected channel deviation data.

18. The system of claim 17 including means for determining common audio compensation requirement data for all speakers based on the common room tuning deviation data.

19. The system of claim 17 including means for determining channel balancing requirement data for the left and right channel pair, the left and right surround channel pair, the center channel and the low frequency channel based on the room corrected channel deviation data.

20. The system of claim 17 wherein the means for equalizing source audio passes source audio through automatically configured multichannel compensation filters to provide equalization on a per channel basis for speakers having differing response characteristics on a per channel pair basis.

* * * * *